US007794036B2

(12) United States Patent
Campagna et al.

(10) Patent No.: US 7,794,036 B2
(45) Date of Patent: Sep. 14, 2010

(54) ENSURING PRINT QUALITY FOR POSTAGE METER SYSTEMS

(75) Inventors: Matthew J. Campagna, Ridgefield, CT (US); Gary G. Hansen, Newtown, CT (US); Frederick W. Ryan, Jr., Oxford, CT (US)

(73) Assignee: Pitney Bowes Inc., Stamford, CT (US)

( * ) Notice: Subject to any disclaimer, the term of this patent is extended or adjusted under 35 U.S.C. 154(b) by 628 days.

(21) Appl. No.: 11/644,760

(22) Filed: Dec. 22, 2006

(65) Prior Publication Data

US 2008/0154799 A1 Jun. 26, 2008

(51) Int. Cl.
*B41J 29/38* (2006.01)

(52) U.S. Cl. ..... 347/14

(58) Field of Classification Search ..... None
See application file for complete search history.

(56) References Cited

U.S. PATENT DOCUMENTS 5,659,342 A * 8/1997 Lund et al. ..... 347/35
6,158,837 A * 12/2000 Hilton et al. ..... 347/19
6,428,132 B1 * 8/2002 Kubatzki et al. ..... 347/7
6,459,858 B1 * 10/2002 Davis ..... 399/2
6,978,255 B1 * 12/2005 Pauschinger et al. ..... 705/61
7,369,784 B2 * 5/2008 Ishihara et al. ..... 399/12
2004/0143710 A1 * 7/2004 Walmsley ..... 711/144
2005/0219336 A1 * 10/2005 Hayasaki et al. ..... 347/86
2006/0044341 A1 * 3/2006 Reichelsheimer et al. ..... 347/19
2006/0290735 A1 * 12/2006 Jang ..... 347/19

FOREIGN PATENT DOCUMENTS

JP 2003266743 A * 9/2003

OTHER PUBLICATIONS

Translation of JP 2003-266743 A.*

* cited by examiner

*Primary Examiner*—Matthew Luu
*Assistant Examiner*—Justin Seo
(74) *Attorney, Agent, or Firm*—George M. Macdonald; Angelo N. Chaclas

(57) ABSTRACT

Print quality is ensured in a postage meter system employing an ink system and having settable modes of printing operation by detecting the type of ink system employed in the postage meter system, setting a first mode of printing operation for the postage meter system when the detected ink system is of a first type and setting a second mode of printing operation for the postage meter system when the detected ink system is of a second type. The detected information may be communicated to a data center to obtain modes of operation for the postage meter system and other corrective actions may be implemented. The method and system are applicable to other consumable item systems employing various types of consumable items.

10 Claims, 4 Drawing Sheets

RECEIVE LIST OF CARTRIDGES FROM PRINTER
80
ADD LIST OF CARTRIDGES AND DATE RECEIVED IN GLOBAL DATABASE
82
84
ARE CARTRIDGES HIGH QUALITY?
NO
YES
CHECK LIST AGAINST GLOBAL DATABASE FOR REUSE
86
88
IS CARTRIDGE BEING REUSED?
NO
YES
90
IS CARTRIDGE ANOTHER VENDOR'S?
NO
YES
94
ATTEMPT TO WIN THE CUSTOMER BACK
92
TAKE NO ACTION
96
PERFORM CORRECTIVE ACTION

ENSURING PRINT QUALITY FOR POSTAGE METER SYSTEMS

FIELD OF THE INVENTION

The invention disclosed herein relates generally to print quality and more particularly to methods and systems for helping to ensure postage meter system print quality.

BACKGROUND OF THE INVENTION

Postage meter systems print indicia and other information on mailpieces such as envelopes. The indicia represents evidence of postage payment for the mailpiece. Different countries have different systems of payment for printed indicia. The payment may be made prior to when the imprint is made, with the prepaid postage value being deducted from the value stored in the postage meter system. Alternatively, payment may be made subsequent to when the imprint is made, based on the various indicia that had been printed. Postal processing equipment scans the face of mail pieces and decodes the data (e.g., barcodes) printed on the mail piece. The data in an indicium provides proof that a specific postage amount was paid. The quality of the print of a postal indicium is the primary factor that determines whether or not postal equipment which scans and images the mail piece can decode the data in the indicium. Therefore, achieving high print quality is critical to ensuring the security of postal funds. Postal services have established quality standards for the indicia image printed on mailpieces. Accordingly, standards have been promulgated by postal services for the quality of the indicia imprint. An example of such standard is set forth International Standard ISO/IEC 18050: Print Quality Attributes for Machine Readable Digital Postage Marks.

In processing mail, when indicia or another imprint on a mailpiece fails to meet the required standard, the mail may be processed in other than the standard manner. When inferior quality inks or ink cartridges are used in postage meter systems, the consequence can be significant and can be more than merely poor images and the failure of proper processing in the post office. It can also involve the loss of funds, the undeliverability of mail and damage to the equipment (e.g., a postage meter) itself. The inferior quality ink may damage the print head of a meter system by permanently clogging or pitting the print head nozzles that are employed to print indicia and other information. This may require that the print head be replaced. Moreover, the mail itself may be returned by the postal service to the sender, causing additional expense and delay in processing the mail. Since postage meter systems are used frequently in high-volume production of mail, the failure to make proper imprints can impact large amounts of mailpieces and have significant commercial consequence to the mailer.

To help avoid printing problems, postage meter manufacturers carefully develop and formulate ink used in postage meter systems. This is to ensure that the inks and ink systems meet the requirements of the specific countries where the postage meter systems are employed. Postage meter manufacturers implement extensive testing, specific formulation and quality assurance programs in the manufacture and storage of postage meter inks. It is, thus, desirable to ensure the proper performance of postage meter systems under various operating conditions, including where improper or inferior quality ink may be employed.

SUMMARY OF THE INVENTION

It is an objective of the present invention to help ensure that print quality is maintained in printing systems employing various inks.

It is also an objective of the present invention to help ensure that print quality is maintained in postage meter systems employing various postage meter inks.

It is a further objective of the present invention to detect the use of non-qualified and/or non-approved inks in postage meter systems to help avoid improper printing.

It is yet a further objective of the present invention to facilitate corrective action should non-qualified ink be employed in a postage meter system.

It is still yet a further objective of the present invention to provide a user with solutions to the utilization of non-qualified inks that enable continued use of the postage meter system.

A method for helping to ensure print quality in a postage meter system employing an ink system and having settable modes of printing operation embodying the present invention includes the steps of detecting the type of ink system employed in the postage meter system, setting a first mode of printing operation for the postage meter system when the detected ink system is of a first type and setting a second mode of printing operation for the postage meter system when the detected ink system is of a second type.

A method for helping to ensure printing quality of indicia by a postage meter system employing ink cartridges and having settable modes of operation also embodying the present invention includes the steps of receiving at a data center information from the postage meter system identifying the postage meter system and an ink cartridge type employed in the postage meter system. Information is retrieved from a data base concerning ink cartridge types adapted to be used in the postage meter system and it is determined if the identified ink cartridge type employed in the identified postage meter system is of a first type for use in the postage meter system. Corrective action is performed if the identified ink cartridge type is other than the first type for use in the postage meter system.

In another embodiment of the present invention, a method for helping to ensure print quality in a postage meter system includes the steps of detecting the type of ink cartridge in a postage meter system and communicating the detected ink cartridge type to a remote data center. At the data center the suitability of the detected ink cartridge type for use in the postage meter system is determined and the results of the determination are communicated to the postage meter system.

A postage meter system adapted to employ an ink cartridge in printing postal indicia embodying the present invention includes printing means for operating the ink cartridge to print, the printing means settable to a normal mode of printing operation and a special mode of printing operation. Means for detecting the ink cartridge type are provided and means are coupled to the detection means and the printing means for changing the mode of operation of the printing means based on the ink cartridge type detected by the detecting means.

In still another embodiment of the present invention, a method for helping to ensure quality in a consumable item system having settable modes of operation includes the steps of receiving at a data center information from the consumable item system identifying the consumable item system and a consumable item type employed in the consumable item system. Information is retrieved from a data base concerning consumable item types adapted to be used in the consumable item system and it is determined if the identified consumable item type employed in the identified consumable item system is of a first type for use in the consumable item system. Corrective action is preformed if the identified consumable item is other than the first type for use in the consumable item system.

DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENT

Figure 1:
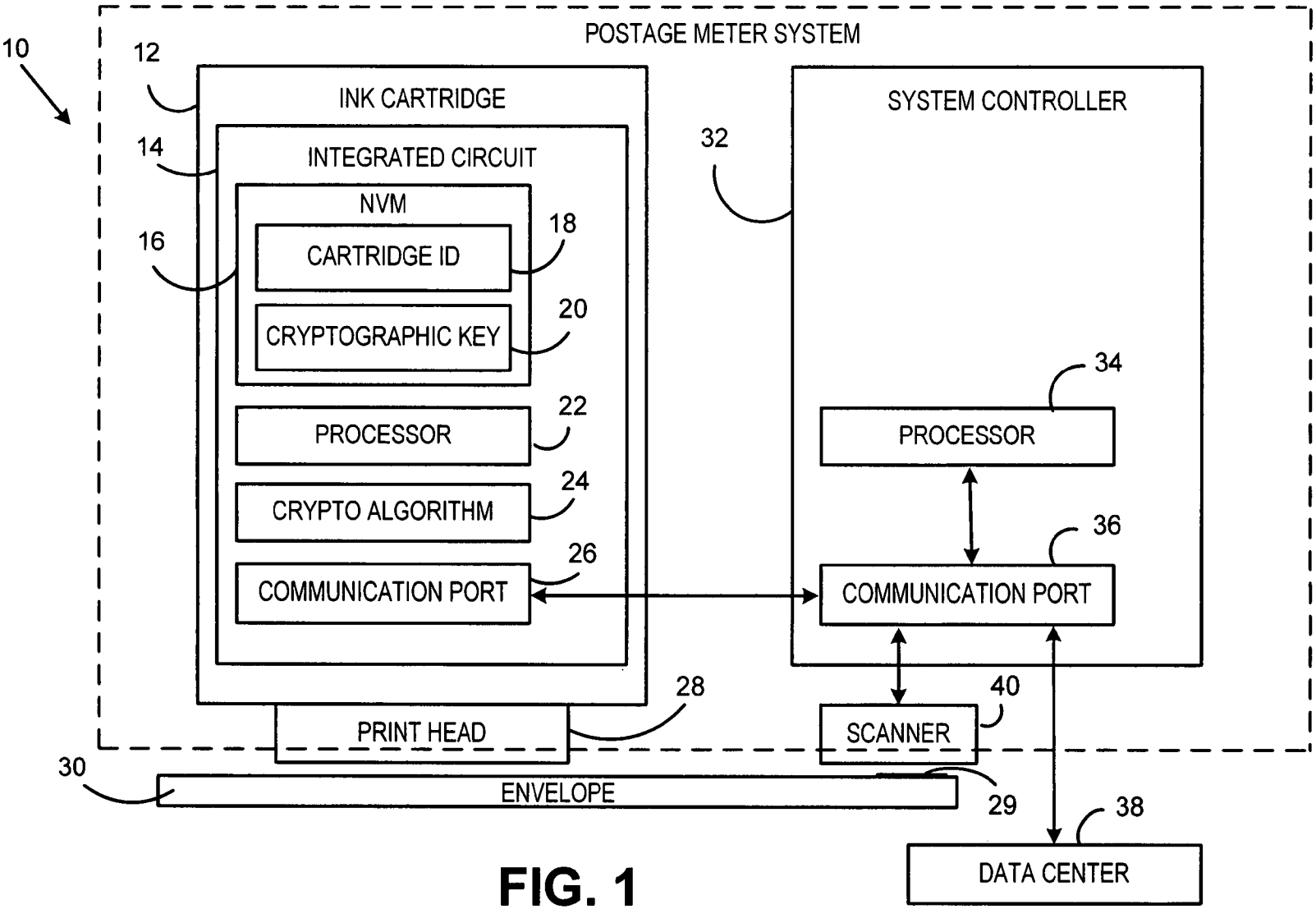
FIG. 1 is a block diagram of a postage meter system embodying the present invention.
Figure 4:
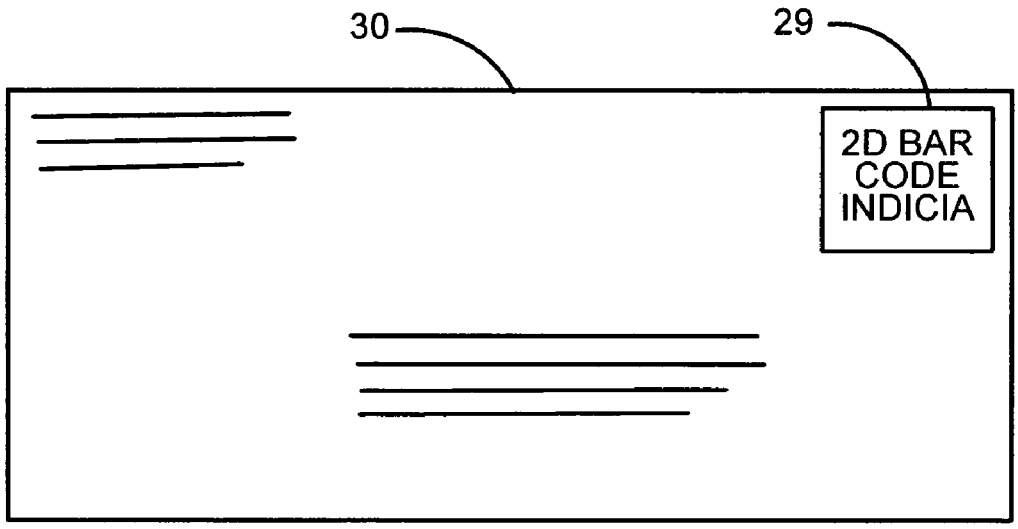
FIG. 4 is another view of the envelope shown in FIG. 1 being imprinted by the postage meter system.

Reference is now made to FIGS. 1 and 4. A postage meter system 10 includes an ink cartridge 12. The ink cartridge 12 contains the supply of ink that is employed by the postage meter system 10 to print indicia and other information. The ink cartridge 12 includes an integrated circuit 14 having a non-volatile memory 16 in which is stored ink cartridge identification information 18 and a cryptographic key 20.

The integrated circuit 14 further includes a processor 22 having a crypto algorithm 24 stored therein and a communications port 26. A print head 28 is connected to the ink cartridge 12 and is adapted to print the indicia 29 and may also be employed to print other information on an envelope 30 using the ink in the ink cartridge 12. The indicia 29 as shown in FIG. 4 can include a two-dimensional bar code as is employed in indicia printed in accordance with the requirements of the United States Postal Service for Information Based Indicia. The ink cartridge communications port 26 is coupled to a postage meter system controller 32 which includes a processor 34 coupled to a communications port 36. The communications port 36 is coupled to communicate with a remote data center 38 and is also coupled to a scanner 40 within the postage meter system 10.

The postage meter system 10 can be any of a large number of different types of postage meter systems. The mechanical, electronic, computing, software, printing and ink, organization and implementation of postage meter systems can vary widely from manufacturer to manufacturer and from country to country. The postage meter system can be a stand-alone, integrated system that both meters postage and processes mailpieces or it can be a separate metering system designed to operate in conjunction with a separate mailing machine. The postage metering system can be a closed metering system where printing and accounting for postage are physically connected or an open metering system where printing and accounting are not physically connected. Accordingly, not all postage metering systems 10 include all of the elements in FIG. 1 (e.g., some systems do not include a scanner 40, some ink cartridges 12 may not include a cryptographic algorithm 24 and cryptographic key 20). These and other postage metering systems are known and are widely employed in the United States and other countries.

Remote data center 38 may contain servers and databases. The databases may be used to store information related to individual meter systems 10 and/or ink cartridges 12 and/or information related to types of meters and ink cartridges. The data may include: whether or not specific types of ink cartridges are suitable for use in specific postage meter systems or types of systems.

Figure 2:
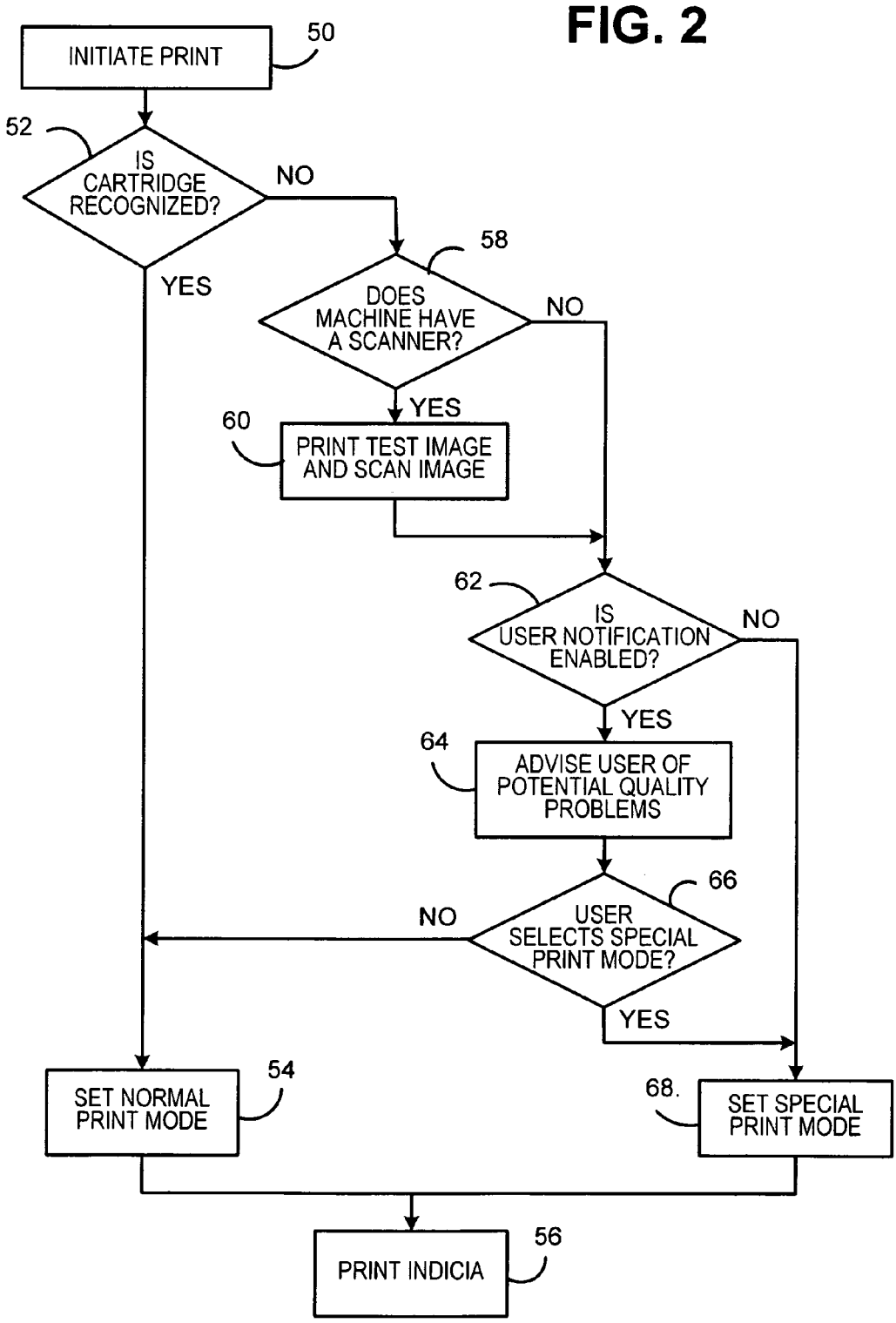
FIG. 2 is a flow chart of the operation of the postage meter system shown in FIG. 1.

Reference is now made to FIG. 2. A print is initiated at block 50 in the postage meter system 10. A determination is made at decision block 52 if the cartridge in the postage meter system 10 is a recognized cartridge. Methods for recognizing inks and ink cartridges are described below. Where the cartridge is recognized, the process continues at block 54, where the postage meter system 10 sets a normal print mode and an indicia is printed at block 56.

Where the cartridge is not recognized at decision block 52, a further determination is made at decision block 58 whether the postage meter system 10 includes a scanner 40. Where the postage meter system 10 includes a scanner 40, a test image is printed and scanned at block 60 and the process continues at decision block 62. The process can also print an actual indicia at block 56, which is then scanned. The information obtained from scanning the indicia would be used for subsequent indicia that are printed. Where the postage meter system 10 does not include a scanner 40, the process also continues at decision block 62.

At decision block 62, a determination is made if the user notification has been enabled. Where the user notification has been enabled, the user is advised at block 64 of the potential print quality problems. User notification can be in any suitable manner. Where the postage meter system 10 includes an image scanner and the image has been scanned, this additional information may be embedded into the user advice as to any quality problems encountered. At decision block 66, the user then determines whether to select a special print mode.

Where the user determines not select a special print mode, the processing continues at block 54 with the normal print mode being set and the indicia printed at block 56. However, where the user determines to select a special print mode, the special print mode is set at block 68 and the indicia is printed with the special print mode at block 56. Where the user has determined at decision block 62 not to enable user notification, the process may be automated based on this decision of the user. The special print mode is set at block 68 and the indicia is printed with the special print mode at block 56.

The process of determining the ink or the ink cartridge type employed can be enabled when the ink supply is refilled or a new ink cartridge is installed, depending on the type of postage meter system, rather than at the initiation of each print cycle. The process can also be conducted by running a test mailpiece or media through the system to determine the nature of the ink or ink cartridge and whether it is a recognized ink or ink cartridge.

Where the ink or ink cartridge is a recognized ink or ink cartridge, the ink or ink cartridge can either be of a type qualified to operate properly with the postage meter system 10 or it can be of a type not qualified to operate properly with the postage meter system 10 and possibly even recognized to cause various printing problems. In the situation where the ink or ink cartridge is not a recognized ink or ink cartridge, it may or may not operate properly with the postage meter system 10. However, in this case the user may desire to implement a precautionary mode of operation of the postage meter system to help insure a high quality indicia imprint or may desire to not use the unrecognized ink or ink cartridge. Based on data obtained from the data center 38, the postage meter system 10 can cause the print head to print or to display the various options that may be available to the user. The display of such options can be via a display associated with the postage meter system 10 or other suitable display. The options can include, for example, depending on how the user wishes to proceed, a list of approved inks and ink cartridges where a non-recognized ink or ink cartridge is employed or where a scanner, such as scanner 40, detects a low quality imprint as well as options concerning various modes of printing.

Figure 3:
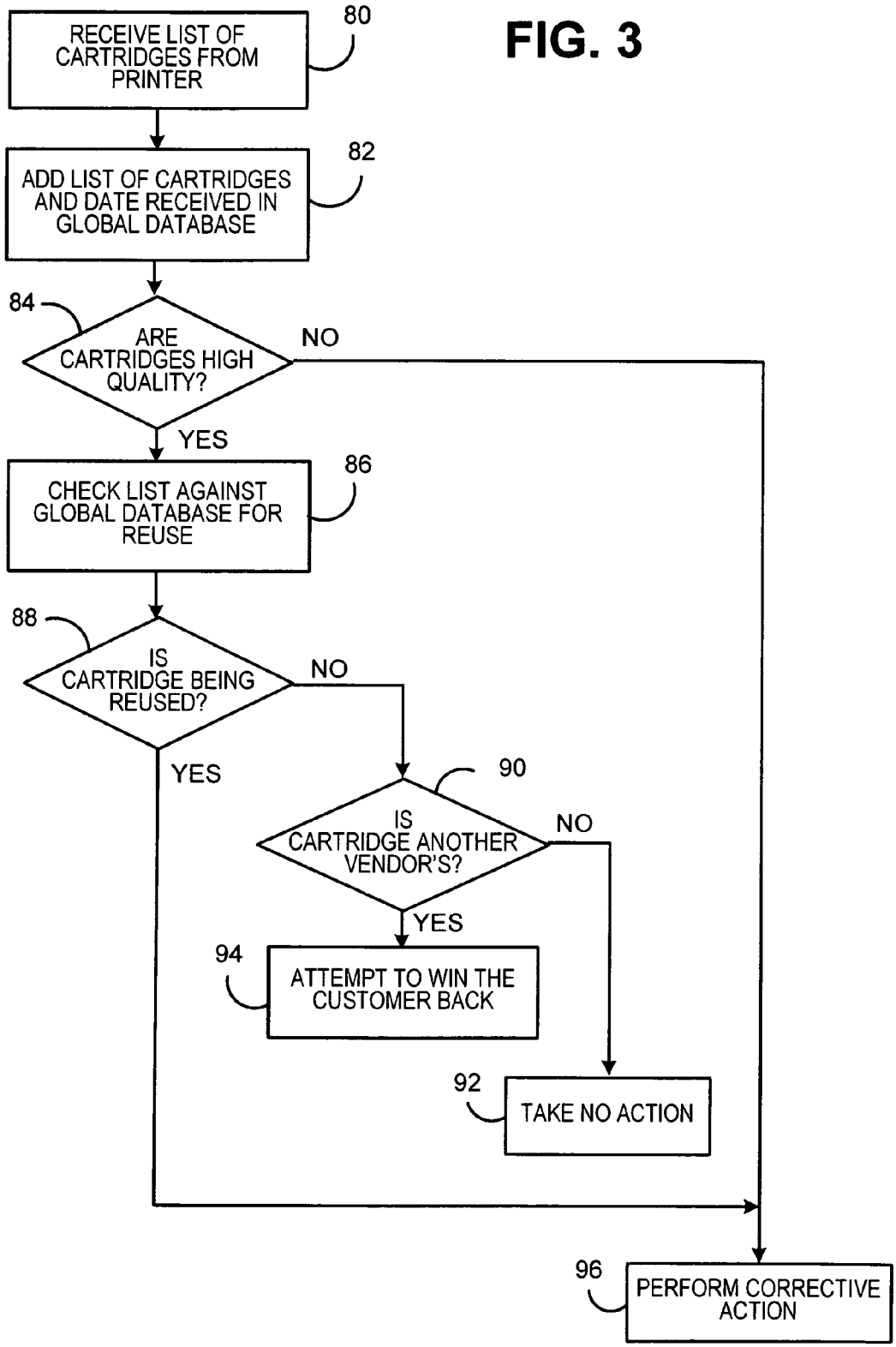
FIG. 3 is a flow chart of the data center shown in FIG. 1.

Reference is now made to FIG. 3. A list of inks and ink cartridges from various postage meter systems such as postage meter system 10 is received at the data center at block 80. This information can be sent at the time of a communication between the postage meter system 10 and the data center 38, for example, for refilling of funds into the postage meter system, the sending of reports concerning the postage meter system operation and usage or during any other normal connections. The communications between the postage meter system 10 and the data center 38 can also be established when the ink supply is replenished or when an ink cartridge 12 is installed into the postage meter system. The list of inks or cartridges and the date received from postage meter system 10 is entered into a global database at block 82.

The database can be a database of all inks and ink cartridges available that are qualified for use in the particular postage meter system, all inks and ink cartridges that have been used in any postage meter system that have created known problems, and other relevant information concerning the various types of cartridges, as well as the various types of corrective actions that can be implemented with respect to the specific types of inks and ink cartridges. The database may also contain information related to the date that an ink cartridge was installed, any print anomalies that may have been detected by a postage meter system 10 analyzing images from scanner 40, and/or the number of prints made by a particular cartridge as reported by a postage meter system 10.

A determination is made at decision block 84 if the cartridge type is recognized, for example, as a high quality ink cartridge. That is, an ink cartridge type that is suitable for use in the particular postage meter system where the ink cartridge is being employed so that a high quality indicia imprint should occur using the particular ink cartridge. Where the cartridge is not recognized or is not suitable for use corrective action is taken at step 96. Possible corrective actions are described below. Where the cartridge is recognized and qualified as being of a high quality, a check is made block 86 whether information about that specific ink cartridge has been previously communicated to the data center 38 and stored in the data base. Information about a specific ink cartridge may include: whether the ink cartridge was previously used in a different meter system, the date the cartridge was initially installed, the number of total imprints produced by the cartridge by other postage meter systems, etc. In certain cases it is possible to determine that the ink cartridge is a re-used ink cartridge that has been refilled with ink (e.g., if the ink cartridge has created more imprints than the capacity of the cartridge should allow). The ink used to refill the ink cartridge may not be suitable for use with the particular postage meter system or the cartridge itself could be worn or damaged.

A determination is made at decision block 88 if the cartridge is being re-used. Where the cartridge is being re-used, a corrective action is performed at block 96. Where the cartridge has not been re-used, a determination is made at decision block 90 if the cartridge is from another vendor. If the cartridge is not from another vendor, no action is taken at block 92. If the cartridge is from another vendor, action can be implemented at block 94 to, for example, win the customer back or determine why the customer is not utilizing the vendor's cartridge.

Various corrective actions that can be implemented at block 96 include controlling the postage meter system via the communications from the data center 38 via the postage meter system processor 34 as to the appropriate special print mode for the particular cartridge being employed. This may help ensure the highest possible quality image is printed for the particular ink cartridge being used in the postage meter system 10. Additionally, the customer can be notified via the postage meter display, computer display, e-mail, letter mail, phone or other means that the print quality may suffer if lower quality inks are used and the potential consequences of such issues. Further, the communications to the customer can include known problems with the specific ink cartridge being employed in the postage meter system 10. That is, a history of destroyed print heads and the like. The customer can be offered various alternative, high quality cartridges that would be suitable for use in the postage meter system 10 and even be sent samples of such ink cartridges.

In addition to the above, the corrective action may also be downloaded into the postage meter 10 from the data center 38, e.g., modes of operation which will help insure a quality imprint for the specific ink cartridge involved. These can include slower print speeds or more frequent maintenance cycles for the ink cartridge print head. These modes of operation may be automatically implemented or implemented by user activation. They may be activated individually or in combination to enhance printing quality.

The user can also be requested to provide a print sample to the postage meter system vendor or third party for analysis to determine the level of acceptability and level of quality of the particular cartridge where the cartridge type is not recognized or in other appropriate circumstances. This sample can be a physical sample sent for analysis or can be a sample from the scanner 40 communicated from the postage meter system 10 communications port 36 to data center 38. Data from the database can also be employed in various marketing activities, such as advertising, promotional sales and the like, based on the information gathered from a large number of postage meter systems in a given geographical area.

Different types of detection systems can be employed in detecting the specific type of ink or ink cartridge in the postage meter system 10. When manufactured, inks and also ink cartridges can be marked in various different ways to operate in conjunction with the detection system employed in the postage meter system or systems where the ink or ink cartridge is intended to be used. These detection systems can be an optical system, for example, a laser scanner barcode detection system. The detection system can be a chemical system which, for example, where a chemical marker or a level of fluorescence in an ink or a stripe or other mark on an ink cartridge is sensed. The detection system can be a mechanical system, where a particular-shaped fitting or structure on the cartridge is detected. The detection system can be electronic, where, for example, it can be a challenge response detection system. Other detection systems and other forms and combinations of the optical, chemical, mechanical and electrical detection systems can be implemented.

The detection system employed in postage meter system 10 is an electronic challenge response detection system. The postage meter system processor 14, via the communications port 36, may query the cartridge integrated circuit 14 to ascertain the identity of the cartridge. The challenge response detection system is implemented in a known manner employing the cryptographic key 20 and the cryptographic algorithm 24.

The postage meter processor 34 may send a challenge (e.g., a random number) via communication port 36 to the ink cartridge integrated circuit 14. The integrated circuit 14 then performs a cryptographic operation on the challenge and the identification data 18 and returns the results via the communication port 36 to the processor 34. This information may be stored in the postage meter systems controller 32 and also subsequently transmitted to the data center 38. The processor 34 may use a corresponding verification algorithm to ensure that the integrated circuit 14 is a valid integrated circuit and not an attempt by a third party to substitute an inferior ink supply as a high quality ink supply. Other forms of electronic detection systems may employ encryption, digital signature creation, message authentication code creation, simple identification of a serial number, reading of a Radio Frequency Identification (RFID) tag, etc.

Regardless of the detection system, if the ink or ink cartridge is recognized as a qualified ink or ink cartridge meeting the print quality requirements, the meter can print using the normal print mode for printing the postal indicia and any other information. If the ink or ink cartridge cannot be identified as one meeting the quality requirements, the postage meter system 10 can enter the special print mode. This provides a quality assurance mode either automatically or with user intervention, depending on how the postage meter system is implemented and set up for operation. The special print mode helps to ensure the quality of printing and may be a mode where there is an increase in the ink density, a scheduling change in the maintenance cycle operation (e.g., more frequent cleaning and purging of the print heads), and/or a slower print throughput. Increasing the ink density employed in printing is an increase of the density or concentration of the ink on the on the envelope 30 used to print the indicia 29 or other information.

The manner in which the print quality is maintained as described herein can be used with various types of ink systems. Ink systems include ink systems with a refillable ink supply and ink cartridge systems where the ink cartridge is replaced when the ink supply is exhausted. The ink systems with refillable ink supply may employ a permanent or a semi-permanent print head.

It should be recognized that the present system has applications beyond printing systems such as postage meter systems. The present system can be employed in applications where consumable devices are employed in systems that are networked to a data center or the consumable device itself is networked to a data center. For example, a networked refrigerator might detect the type of water filters employed in the refrigerator. In such a situation, the water filter would be a consumable. A networked water cooler might detect the type of the bottled water used in the water cooler. For example, the water bottle is the consumable container and it identifies the water manufacturer used in the consumable. A vacuum cleaner might detect the type of the vacuum-cleaning bag employed in the vacuum cleaner. The vacuum could then communicate the manufacturer of the bag to a data center. The communications can be through hard-wired or wireless communications systems or through a consumer home network and the like.

While the present invention has been disclosed and described with reference to a single embodiment thereof, it will be apparent, as noted above, that variations and modifications may be made therein. It is, thus, intended in the following claims to cover each variation and modification that falls within the true spirit and scope of the present invention.

What is claimed is:

1. A method for helping to ensure quality in a postage meter system employing an ink system and having settable modes of printing operation, comprising the steps of:

detecting the type of ink system employed in said postage meter system;

setting a first mode of indicia printing operation using normal ink density printing on mailpieces for said postage meter system when said detected ink system is of a first type; and, setting a second mode of indicia printing operation using higher than normal ink density printing on mailpieces for said postage meter system when said detected ink system is of a second type wherein said second mode of indicia printing operation with said second type ink system is a special printing mode to enhance the quality of indicia printing using slower than normal print throughput resulting when employing said ink system of said second type.

2. The method for helping to ensure quality in a postage meter system employing an ink system and having settable modes of printing operation as defined in claim 1 wherein said second mode of indicia printing operation increases the density of ink employed in printing.

3. The method for helping to ensure quality in a postage meter system employing an ink system and having settable modes of printing operation as defined in claim 1 wherein said second mode of printing operation increases the frequency of maintenance cycles for said ink system.

4. The method for helping to ensure quality in a postage meter system employing an ink system and having settable modes of printing operation as defined in claim 1 wherein said second mode of printing operation slows the speed of the printing process.

5. The method for helping to ensure quality in a postage meter system employing an ink system and having settable modes of printing operation as defined in claim 1 wherein said ink system is an ink cartridge type ink system.

6. The method for helping to ensure quality in a postage meter system employing an ink system and having settable modes of printing operation as defined in claim 1 wherein said ink system is a refillable ink supply type ink system.

7. A method for helping to ensure printing quality of indicia by a postage meter system employing ink cartridges and having settable modes of operation, comprising the steps of:

receiving at a remote data center information from said postage meter system identifying said postage meter system and an ink cartridge type employed in said postage meter system;

retrieving from a data base information concerning ink cartridge types used with said postage meter system;

determining if said identified ink cartridge type employed in said identified postage meter system is of a first type for use in said postage meter system; and, performing corrective action if said identified ink cartridge type is not of said first type for use in said postage meter system, wherein, said postage meter system includes settable modes of operation including a normal mode of operation for printing postal indicia and a special mode of operation for printing postal indicia and wherein said corrective action is setting said settable mode to said special mode of operation, and wherein, said special mode of operation for printing postal indicia printing increases the density of ink employed in printing and uses slower than normal print throughput.

8. The method for helping to ensure printing quality of indicia by a postage meter system systems employing ink cartridges and having settable modes of operation as defined in claim 7 wherein said special mode of operation for printing postal indicia printing increases the frequency of maintenance cycles for said ink cartridge.

9. The method for helping to ensure printing quality of indicia by a postage meter system employing ink cartridges and having settable modes of operation as defined in claim 7 wherein said special mode of operation for printing postal indicia printing slows the speed of the printing process.

10. The method for helping to ensure printing quality of indicia by a postage meter system employing ink cartridges and having settable modes of operation as defined in claim 7 wherein said corrective action is identifying options for said postage meter system.

* * * * *